United States Patent [19]

Gibson, III

[11] Patent Number: 4,939,408

[45] Date of Patent: Jul. 3, 1990

[54] HIGH PRESSURE SODIUM DISCHARGE REFLECTOR LAMP

[75] Inventor: Ray G. Gibson, III, Bath, N.Y.

[73] Assignee: North American Philips Corp., New York, N.Y.

[21] Appl. No.: 212,811

[22] Filed: Jun. 29, 1988

[51] Int. Cl.[5] ..... H01J 61/34

[52] U.S. Cl. ..... 313/25; 313/113; 313/573; 313/634; 313/642

[58] Field of Search ..... 313/25, 113, 642, 643, 313/573, 574, 576, 634

[56] References Cited

U.S. PATENT DOCUMENTS 4,481,446 11/1984 Tsuchihashi et al. ..... 313/25 X
4,622,485 11/1986 Miyashita et al. ..... 313/25
4,758,759 7/1988 Scholz et al. ..... 313/25

FOREIGN PATENT DOCUMENTS 51-16953 3/1976 Japan .
59-15174 4/1984 Japan .
2067826 7/1981 United Kingdom .
2157882 10/1985 United Kingdom .

*Primary Examiner*—Kenneth Wieder
*Attorney, Agent, or Firm*—Emmanuel J. Lobato

[57] ABSTRACT

A high pressure sodium discharge reflector lamp having a blown glass outer envelope. The outer envelope contains a rare gas having a fill pressure slightly less than one atmosphere and a pressure at lamp operating temperature of approximately one atmosphere for implosion protection.

10 Claims, 7 Drawing Sheets

HIGH PRESSURE SODIUM DISCHARGE REFLECTOR LAMP

CROSS-REFERENCE TO RELATED APPLICATIONS

The copending application filed concurrently with this application Ser. No. 212,803 entitled High Pressure Sodium Discharge Lamp Having Gas Filled Outer Envelope of Ray G. Gibson, III and Joseph Steven Droho discloses and claims an HPS lamp having a gas filled outer envelope with structure for preventing electrical breakdown through the gas atmosphere of the outer envelope.

The copending application filed concurrently with this application Ser. No. 212,818 entitled High Pressure Sodium Discharge Tube Support Structure of Ray G. Gibson, III and Jagannathan Ravi discloses and claims an HPS lamp having a gas filled outer envelope with discharge tube support structure designed to operate in a rare gas atmosphere and to avoid electrical breakdown through the gas atmosphere.

BACKGROUND OF THE INVENTION

The present invention relates to high pressure sodium vapor high intensity discharge lamps, and more particularly to reflector lamps having a high pressure sodium discharge light source.

High pressure sodium discharge lamps are comprised of a discharge device mounted in an evacuated outer envelope. The discharge device is typically a ceramic discharge vessel comprised of alumina or sapphire and having conductive terminals for receiving an operating voltage. The conductive terminals are niobium which is used because its coefficient of thermal expansion matches that of alumina and because it is resistant to sodium vapor. Titanium solder is used in connections to the niobium.

The outer envelope is evacuated in order to thermally isolate the discharge device, and to avoid reactions of any gas within the outer envelope with the discharge device. Nitrogen, which is used in the outer envelope of other types of high intensity discharge lamps, cannot be used in high pressure sodium lamps because of its reactivity with niobium and titanium at high temperature.

The evacuated outer envelope of high pressure sodium lamps must be strong and able to withstand severe mechanical impacts without breaking. If the lamp outer envelope were to break, it would implode scattering glass fragments and create a safety hazard.

It has been the practice to manufacture high pressure sodium lamps with evacuated outer envelopes, and to make those envelopes sufficiently strong to avoid breakage. However, high envelope strength is not feasible in the case of many reflector lamps. Reflector lamp envelopes have a large face that merges with the envelope side walls at an edge portion having a small radius of curvature. The atmospheric pressure acting on the evacuated envelope causes high stress concentrations in the edge portion and makes it susceptible to breakage. Moreover, reflector lamps have thin blown glass envelopes and cannot be strengthened by making them substantially thicker. Incandescent reflector lamps having blown glass envelopes uniformly contain a fill gas with an internal pressure of about one atmosphere. With the inner and outer pressures acting on the envelope being approximately equal, no implosion will occur if the envelope breaks and there is less apt to be flying glass fragments.

There has been some consideration of gas filled high pressure sodium lamps. U.S. Pat. No. 3,932,781 issued to Jozef C.I. Peeters et al discloses a high pressure sodium lamp having an outer envelope that is gas filled to inhibit evaporation of the alumina discharge tube. This reduces the deposition of alumina on the outer envelope and the attendant reduction in light output. The results of experiments involving such a lamp are also disclosed in the article by R.J. Campbell et al, "Evaporation studies of the sintered aluminum oxide discharge tubes used in high pressure sodium (HPS) lamps", Journal of the IES, July 1980, pages 233–239.

Other patents showing gas-filled outer envelopes include U.S. Pat. No. 3,753,018 issued to Louis Benjamin Beijer et al. which discloses a metal halide lamp having an outer envelope filled with a mixture of nitrogen and neon. Similarly, U.S. Pat. No. 4,345,178 issued to John A. Pappas et al. discloses a metal halide reflector lamp having a sealed beam reflector envelope filled with nitrogen. U.S. Pat. No. 4,490,642 issued to Alexander Dobrusskin et al. discloses a high pressure sodium discharge lamp with surrounding inner and outer envelopes surrounding an HPS discharge tube. The space between the discharge tube and the inner envelope is filled with a gas, and the space between the inner and outer envelope preferably has a high vacuum.

No consideration has been given regarding how to realize practical high pressure sodium reflector lamps made using blown glass envelopes and having gas filled envelopes to avoid implosion.

Accordingly, it is an object of the invention to realize a practical high pressure sodium reflector lamp having a blown glass envelope.

It is another object of the invention to realize a high pressure sodium reflector lamp that is practicable to be operated in any orientation.

SUMMARY OF THE INVENTION

In a reflector lamp according to the invention, a high pressure sodium discharge device operates as a light source mounted within a sealed outer envelope. A reflective layer on a portion of the outer envelope is effective for reflecting light from the light source and directing the reflected light. A quantity of rare gas is contained within the sealed outer envelope and has a fill pressure at room temperature of slightly less than one atmosphere. At the lamp operating temperature the pressure of the fill gas in the outer envelope is approximately one atmosphere so that no substantial pressure difference exists between the lamp envelope interior and exterior. As a consequence, if the lamp outer envelope breaks both violent implosion and explosion are avoided.

The lamp outer envelope is a blown glass envelope. It is comprised of a translucent dome end, a narrow base end, and a mid-section converging from the dome end to the base end. The reflective layer is disposed covering a portion of the converging mid-section for reflecting light emitted within the envelope out through the dome end. The high pressure sodium discharge device within the envelope is positioned to emit light incident on the reflective layer for reflection out through the dome end of the lamp envelope. The lamp according to the invention further comprises support means for supporting the discharge device within the envelope at a selected position effective to impart a predetermined beam spread to the light emitted from the dome end of the envelope.

The high pressure sodium discharge device is elongate and is mounted within the lamp envelope with one end of the discharge device closer to the lamp base than the other end of the discharge device. The lamp further comprises thermal control means for controlling the relative thermal dissipation of the ends of the discharge device for rendering its operating voltage insensitive to the orientation of the lamp during lamp operation. In one embodiment the thermal control means is comprised of means for elevating the temperature of the end of the discharge device closest to the lamp base. This means for elevating the temperature is a heat shield on the end of the discharge device closest to the lamp base.

In another embodiment the discharge device has a hollow cylindrical sidewall and end walls closing the tubular body, and a pair of discharge electrodes disposed within the tubular body at opposite ends thereof for defining a discharge gap between them. Electrode mounting means mount the discharge electrodes within the tubular body at opposite ends of it and positioned spaced a certain distance from the adjacent end wall of the tubular body. The thermal control means is comprised of the electrode mounting means mounting the discharge electrode at the lamp base end of the tubular body closer to the adjacent end wall then the discharge electrode at the lamp dome end is to its adjacent end wall.

In another embodiment the discharge device has end walls of different thicknesses. The thicker end wall dissipates more heat than the thinner end wall and thus operates at a lower temperature then the thinner end wall. The thermal control means is comprised of the thicker end wall being at the end of the discharge device closest to the dome end of the outer envelope.

DETAILED DESCRIPTION OF THE INVENTION

Figure 1:
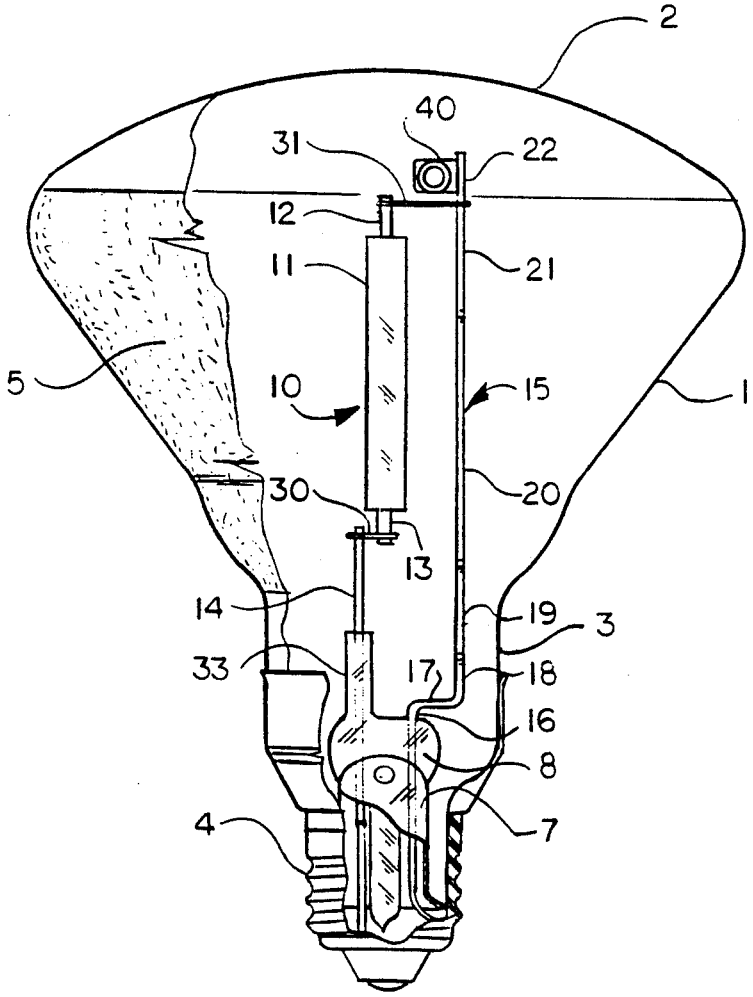
FIG. 1 is a partial vertical section of an HPS reflector lamp with blown glass envelope according to the invention.

FIG. 1 illustrates a high pressure sodium reflector lamp having a blown glass envelope. The envelope has a transparent or translucent front dome 1 from which light is emitted during lamp operation. A mid-section 2 converges toward a narrow neck 3 which terminates at the base end of the lamp envelope. A lamp base 4 is mounted on the base end of the envelope opposite the front dome 1.

A reflective layer 5 is disposed over at least a portion of the converging mid-section 2 of the lamp envelope. It is illustrated extending up to the edge of the dome 1 of the lamp envelope, and down onto a part of the narrow neck 3. The reflective layer 5 is typically metallic aluminum which is vapor deposited on the inner surface of the envelope. A high pressure sodium discharge device 10 is mounted axially symmetrically within the envelope and emits light which is incident on the reflective layer 5. The convergence of the envelope mid-section 2 having the reflective layer 5 is effective to reflect light from the light source 10 in a forward direction through the dome end of the envelope so as to concentrate the light and give it directivity.

The high pressure sodium discharge device 10 has a translucent body 11 and a pair of terminals 12, 13 each extending from a respective end of the tubular body 11. When a sufficiently high voltage is applied across the terminals 12 and 13, an electrical discharge is established between a pair of spaced internal electrodes (not shown) within the tubular body 11 and intense visible light is emitted.

The discharge device 10 is mounted within the envelope by a frame structure which also comprises conductors for applying an operating voltage to the discharge device. The base end of the envelope is closed by a stem 7 which is terminated at a pinch seal 8. A pair of rigid support conductors 14, 15 emerge from the pinch seal 8 and extend longitudinally of the envelope toward the dome end 1. The shorter conductor 14 has a free end which is connected to the terminal 13 of the discharge device by a conductive link 21. Similarly, the free end of the longer conductor 15 is attached to the terminal 12 by the conductive link 22. Each of the support conductors 14, 15 extend into the pinch seal 8 and are connected by respective conductive leads to the lamp base 4, in a conventional manner. Consequently, a voltage applied across the lamp base 4 is developed across the terminals 12, 13 of the high pressure sodium discharge device 10 for energizing it to emit light.

In order to avoid the danger of implosion upon breakage of the outer envelope 1, the outer envelope contains rare gas at a fill pressure of about 700 torr at room temperature. At the lamp operating temperature, the rare gas pressure is greater than one atmosphere (760 torr), in one example 930 torr, so there is no substantial pressure difference across the wall of the lamp envelope. Consequently, if the envelope is broken there will be no substantial pressure difference to accelerate glass fragments and cause flying fragments of the broken envelope. The rare fill gas within the outer envelope thus makes it safe to use thin blown glass outer envelopes in high pressure sodium reflector lamps.

The use of a rare fill gas in the outer envelope of a high pressure sodium lamp has certain consequences for the lamp's characteristics. These in turn dictate that the lamp incorporate certain structural features.

A major and substantial consequence of the use of the rare fill gas is the lowering of the breakdown voltage between internal lamp components. The American National Standards Institute (ANSI) recommends that the lamp be able to withstand an a.c. voltage of 4,000 volts peak. Commercially available high pressure sodium lamp starters produce a voltage pulse of up to 4000 volts having a duration of one millisecond. Conventional high pressure sodium lamps have a high internal vacuum of less than $10^{-4}$ torr in their outer envelope. As a result, internal metal components, such as discharge device mounting frame parts, can be as close as about three millimeters without a breakdown occurring at 4000 volts applied to the lamp.

The higher pressure rare gas fill increases the probability of internal voltage breakdown being caused by the 4,000 volt starting pulse. In order to avoid breakdown from occurring, the metallic components of the discharge device mounting structure are shaped to maximize the distance between the support conductors 14 and 15 that have an electrical potential between them during lamp operation.

Figure 2:
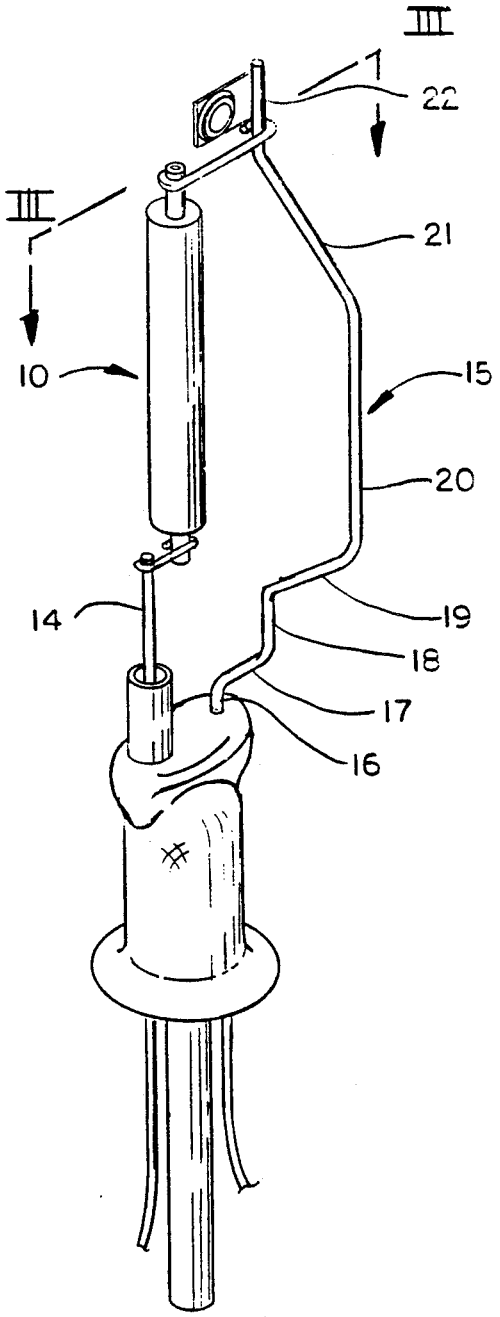
FIG. 2 is an isometric view of the discharge tube support structure shown in FIG. 1.

As shown in FIG. 2, the discharge device 10 is positioned on the lamp center line, and the short straight conductor 14 is on one side of the center line. The conductor 15 emerges from the pinch seal 8 on the opposite side of the lamp center line, and after a short length 16 it is bent perpendicular to the conductor 14. The section 17 of the conductor 15 extends perpendicularly away from the conductor 14, and is bent to define a portion 18 extending parallel to the conductor 14. The next portion 19 extends away from the imaginary plane defined by the conductor 14 and the portions 16 and 17 of the conductor 15. The next section 20 again extends parallel to the lamp longitudinal direction, and the successive section 21 extends back toward the original line of direction of the section 18. The last section 22 of the conductor 15 extends along the same line of direction as the section 18. This structure allows sufficient separation between the conductors 14 and 15 and at the same time avoids the conductor 15 from coming too close to the reflective layer 5, which is typically a metallic and conductive layer such as aluminum.

Section 16 of the conductor 15 is the part that is closest to the conductor 14. This is where electrical breakdown is most likely to occur. In order to reduce the likelihood of breakdown, a glass sleeve 33 covers the portion of the conductor 14 opposite the section 16 of the conductor 15. The glass sleeve 33 increases the breakdown voltage between the conductors 14 and 15. The gas krypton was used in a reflector lamp having the glass sleeve 33 and did not break down. Thus, krypton fill gas provides a practicable way of eliminating the implosion problem.

In order to establish the effectiveness of the glass sleeve 33, high pressure sodium reflector lamps were made which were identical except that some had the sleeve and some did not. The lamps had 70 watt HPS discharge devices mounted in an RL-38 outer envelope filled with krypton at a pressure of 700 torr. The space between the conductor 14 and the section 16 of the conductor 15 was eight millimeters. After the lamp reached normal operating temperature, and power was interrupted, the application of a 4,000 volt one microsecond pulse caused arcing between the conductors 14 and 15, in the lamp without a glass sleeve. For the lamp with the glass sleeve 33, no arcing occurred as long as the terminal 13 of the HPS discharge device 10 was at least 13 millimeters from the conductor 15.

Figure 3:
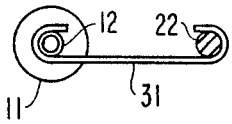
FIG. 3 is a partial cross section of the support structure shown in FIG. 2.

To further improve the breakdown characteristics of the lamp internal structure, all metallic parts are configured to eliminate sharp points and edges. Sharp points create regions of electric field concentration and may facilitate localized ionization of the rare fill gas which could initiate a breakdown between the conductors 14 and 15. In HPS lamps the discharge device is frequently attached to the supporting conductors by thin metallic ribbons or straight rigid rods. In the present invention, connectors 30 and 31 are made from wire having a circular cross section and are wrapped around the respective discharge device terminal and support conductor in the manner shown in FIG. 3. This eliminates the sharp edges or ends inherent in the prior art structure and avoids any attendant reduction in breakdown voltage. In a lamp having argon at 700 torr in the outer envelope, the curved connectors 30, 31 increased the breakdown voltage by 1000 peak a.c. volts relative to straight rod connectors.

A getter support 40 is attached to the section 22 at the free end of the conductor 15. This position maximizes the distance of the getter support 40 from the conductor 14 and also avoids reducing the internal breakdown voltage of the mounting frame structure.

The rare fill gas also contributes to dissipation of heat developed in the discharge device 10 during lamp operation. HPS discharge devices have minimum operating temperatures. If they are not sufficiently heated during operation their internal sodium vapor pressure will be too low and the light output will be substantially reduced. In order to compensate for thermal losses through the rare fill gas, the discharge device 10 is physically smaller than a discharge device for the same wattage used in an evacuated HPS lamp. The lamps described herein have a discharge device length of 41.8 millimeters as compared to the standard 48.0 millimeter length, and a 4.0 millimeter inside diameter as compared to the 4.8 millimeter standard. The smaller physical size reduces the area of the discharge device through which heat can transfer to the rare fill gas so that the discharge device operates at the correct temperature even though substantial amounts of thermal energy can be transferred through the rare gas.

The smaller HPS discharge device 10 results in a lamp for which the beam spread is substantially determined by the position of the discharge device along the center line of the lamp. This is shown by the data in the following Table I. The beam spread of the lamp can be set between 15 and 96 degrees by selecting the position of the discharge device within an interval of 15 millimeters. This broad range in beam spread was achieved with an RL-38 outer envelope.

TABLE I

| Mount Height (mm) | Beam Spread (deg.) | ANSI Notation |
|---|---|---|
| 72 | 15 | NSP |
| 74 | 23 | SP |
| 82 | 53 | WFL |
| 87 | 96 | VWFL |

The RL-38 bulb has a seal length (the distance from the base of the stem 7 to the dome 1) of 130 mm. The mount height is measured from the base of the stem 7 to the center of the discharge device 11. The lamps for which data is reported in Table I had a discharge device 41.8 mm in length, with an arc length of about 21 mm.

In the case of very wide flood lamps the HPS discharge device 10 is relatively closer to the dome end of the lamp envelope 1. This results in the lamp voltage being strongly dependent upon the orientation of the lamp during operation. When the lamp is operated in a base-up orientation the cooler end of the discharge device 10 will be at the dome end of the discharge envelope. Consequently, the sodium amalgam within the discharge device will condense at that end. On the other hand, when the lamp is operated in a base-down orientation the colder end of the discharge device will be at the base end of the discharge device 10 and that is where the sodium amalgam will condense.

In the base-up orientation, the lamp voltage will too high because of excessive reflected heat back onto the end of the discharge device which elevates the discharge device temperature. It was found that for the 70 watt lamp, the lamp voltage was 49.6 volts in the base-down orientation and 62.6 volts in the base-up orientation. The discharge device may be made unsymmetrical in order to eliminate the lamp voltage sensitivity to lamp operating position.

Figure 4:
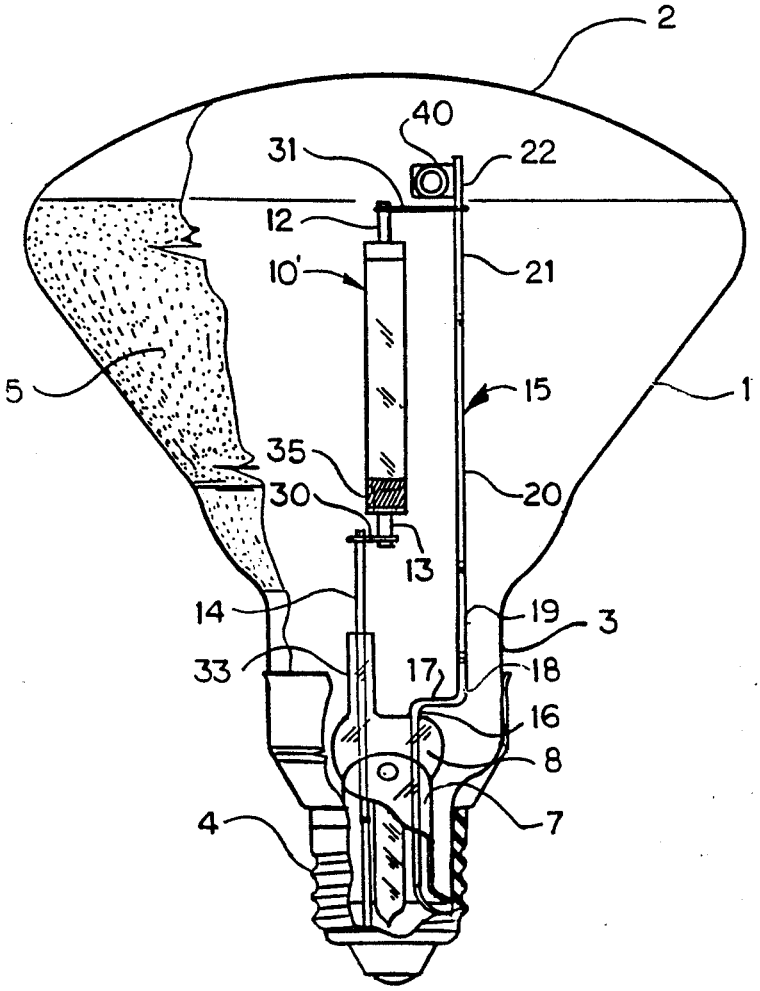
FIG. 4 is a partial vertical section of an HPS reflector lamp with a blown glass envelope in which the discharge tube has thermal control structure.

FIG. 4 illustrates an HPS reflector lamp having a discharge device 10' with a heat reflector 35 at its end closest to the lamp base. The heat reflector is effective for reflecting internally generated heat back into the discharge device 10' and maintaining the end of the discharge device 10' with the heat reflector 35 at a higher temperature.

Figure 5:
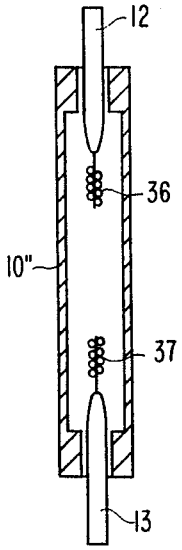
FIG. 5 is a vertical section of a high pressure sodium discharge tube having unsymmetrical structure for thermal control.

An alternative to the use of a heat reflector is the asymmetrical discharge device 10'' shown in FIG. 5. A pair of discharge electrodes 36, 37 are mounted internally at the ends of connectors 12 and 13, respectively. The distance from an electrode tip to an end wall of the discharge device 10 affects the end temperature of the discharge device; the shorter the distance the higher the temperature. A discharge device 10'' with an electrode tip to end wall distance for the electrode 36 of 7.75 millimeters and the tip to wall dimension for the electrode 37 of 7.25 millimeters was used in a reflector lamp with an RL-38 outer envelope. As shown in Table II, the 0.5 millimeter shorter distance reduced the variation in operating voltage to less than one volt.

TABLE II

| Electrode configuration | lamp voltage base down | lamp voltage base up | Δv |
|---|---|---|---|
| asymmetrical | 48.4 | 49.2 | 0.8 |
| symmetrical | 49.6 | 62.6 | 13.0 |

An asymmetrical discharge device can also be realized with equal electrode tip to end wall distances for both electrodes but with end walls of different thicknesses. The thicker end wall will dissipate more heat than the thinner end wall and thus operate at a lower temperature than the thinner end wall. By making the discharge device end wall that is closer to the envelope dome thicker than the more distant end wall, the heat reflected back from the envelope dome will be dissipated and the sensitivity of lamp operating voltage to position will be diminished.

Another approach to preventing electrical breakdown between the internal support conductors is to provide a circuit path within the lamp that will become conductive before unintentional breakdown occurs. The lamp shown in FIG. 6 includes an HPS discharge device 50 mounted within a lamp envelope by support conductors 51, 52 in the manner previously described. A voltage across the conductors 51, 52 is the voltage which is applied to the discharge device 50 for operating it. The lamp outer envelope contains the rare gas argon at a pressure of the order of 700 torr.

A switching device 60 is incorporated in the lamp to define a circuit path having a selected breakdown voltage which is lower than the breakdown voltage between the conductors 51 and 52. The circuit path is isolated from the argon atmosphere in the lamp envelope and has a normally high impedance. When the voltage between the support conductors 51 and 52 exceeds a certain threshold voltage a low impedance circuit path is established between the conductors 51, 52 through the switching device 60.

The switching device 60 is a spark gap device comprised of a non-conductive cylindrical wall 61 and conductive end closures 62, 63 and having an internal chamber. Internal electrodes 64, 65 are each mounted on a respective one of the conductive end closures 62, 63. Lead 66 extends from the conductive end closure 62, and lead 67 extends from the conductive end closure 63. The leads 66 and 67 are each connected to a respective one of the conductors 52, 51 so that the potential applied across the discharge device 50 is also applied across the spark gap device 60. The chamber of the spark gap device 60 has a gas fill selected to establish a particular breakdown voltage.

The voltage difference between the conductors 51 and 52 is applied through the leads 66 and 67 to the respective conductive end closures 62 and 63. Consequently, the voltage difference between the conductors 51 and 52 exists between the internal electrodes 64, 65. When that voltage difference exceeds the selected breakdown voltage of the spark gap device 60, the gas fill within the spark gap device 60 ionizes and a discharge or spark occurs between the internal electrodes 64 and 65. The spark gap device 60 has a low impedance and is conductive, and the voltage difference between the conductors 51 and 52 is short circuited before breakdown of the argon fill gas within the lamp outer envelope can occur.

When the voltage between the conductors 51 and 52 decreases below the switching device threshold voltage, the discharge through the gas fill within the device 60 stops and its impedance increases to the normal high impedance value. The switching device 60 is a self-restoring device and can be repeatedly switched to its low impedance conductive state and each time it will return to its high impedance condition after the applied voltage decreases below its threshold voltage.

Figure 6:
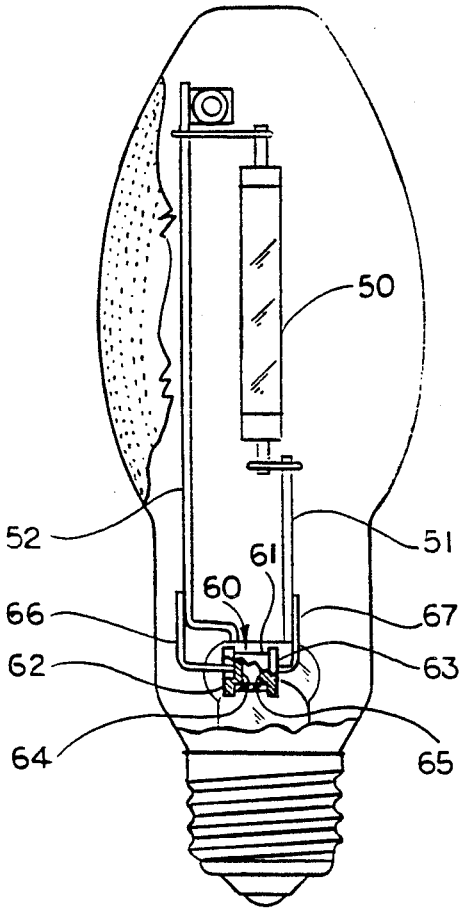
FIG. 6 is a partial vertical section of an HPS reflector lamp according to the invention having structure for preventing internal electrical breakdown.
Figure 7:
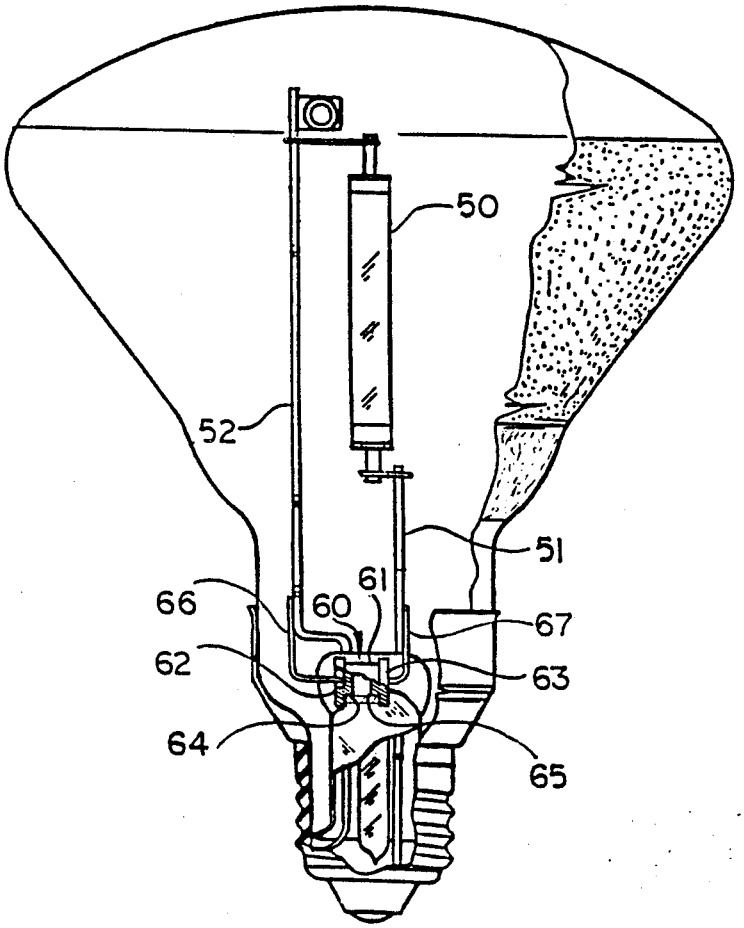
FIG. 7 is a partial vertical section of an HPS reflector lamp like that shown in FIG. 1 and having structure for preventing internal electrode breakdown.

FIG. 7 illustrates a reflector lamp having a discharge switching device like that incorporated in the lamp of FIG. 6. The controlled and isolated discharge path provided by the switching device is particularly advantageous in a reflector lamp. The reflector lamp includes a reflective layer such as metallic aluminum which is conductive. The metallic reflective layer can provide part of a breakdown path between the conductors 51 and 52. For example, an electrical breakdown could occur through the argon fill gas between the conductor 51 and the reflective layer, and between the reflective layer and the conductor 52. The metallic conductive layer would thus provide part of the breakdown path between the conductors.

Figure 8:
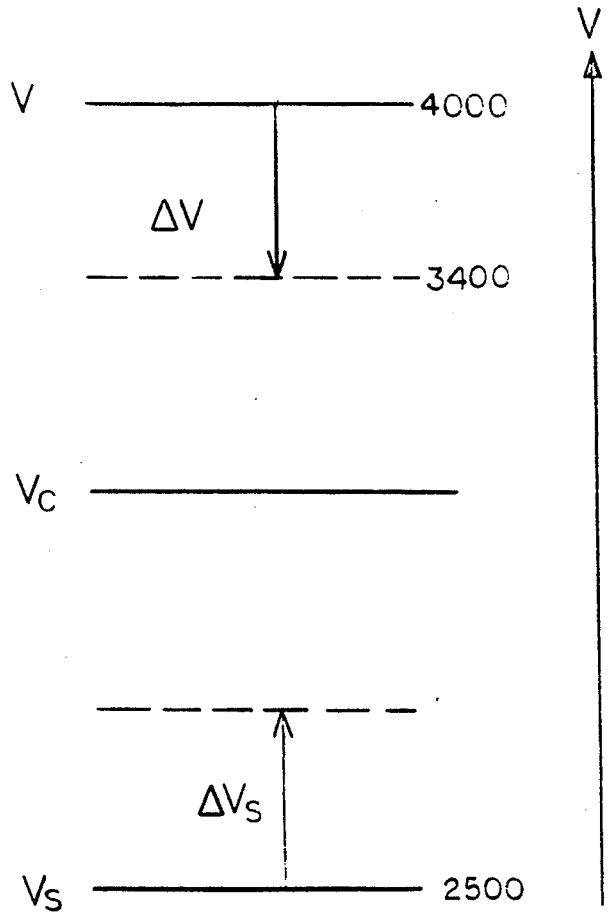
FIG. 8 is a graph illustrating the relative magnitudes of different voltages that characterize the lamp operation.

FIG. 8 illustrates the relationship among the various voltage magnitudes which define the modes of operation of the invention. The starting voltage $V_s$ of the discharge device 10 is typically around 2500 volts for a high pressure sodium lamp; the 70 watt discharge device used in the lamps made and discussed herein have a starting voltage of less than 1800 volts. The maximum voltage $V_{max}$ that the lamp should withstand is nominally 4,000 volts. The controlled breakdown voltage $V_c$ of the spark gap device is selected to have a value between $V_s$ and $V_{max}$.

Both $V_s$ and $V_{max}$ change as the temperature of the lamp increases during lamp operation. As the lamp heats, the breakdown voltage of the argon gas within the lamp outer envelope decreases. This was an unexpected result because the breakdown voltage should have been independent of pressure at the constant gas density expected in a sealed lamp. The decrease in breakdown voltage was measured in a lamp having an outer envelope filled with argon at 700 torr and a stem like that shown in FIG. 2 but without the glass sleeve 33. At the lamp operating temperature, the internal breakdown voltage will decrease by about 500 volts to 3500 volts. At the same time, the internal pressure of the sodium vapor within the discharge device 10 increases substantially and the starting voltage increases. In fact, the starting voltage may increase to a value greater than the controlled breakdown voltage $V_c$ of the arc gap device. The breakdown voltage $V_c$ must therefore be selected less than the lowered maximum voltage $V_{max}$ that the lamp can withstand, but it should be higher than $V_s$ so that the lamp can be restarted without having to first cool down completely. A good nominal value for $V_c$ is around 3,000 volts.

The use of the switching device 60 is not limited to reflector lamps. It can also be applied to high pressure sodium lamps having conventional envelopes but which have a rare gas fill rather than a high vacuum. Such lamps might use the rare gas to limit discharge device material evaporation as discussed above. The problem of internal electrical breakdown through the rare gas could also be solved with the switching device as it is in reflector lamps.

What is claimed is:

1. A high pressure sodium discharge reflector lamp, comprising:

a blown glass envelope having a translucent dome end, a narrow base end, and a mid-section converging from the dome end to the base end, and a reflective layer disposed covering a portion of said converging mid-section for reflecting light emitted within said envelope out through said dome end;

a high pressure sodium discharge device within said envelope and positioned to emit light incident on said reflective layer for reflection out through said dome end of said lamp envelope;

support means for supporting said discharge device within said envelope at a selected position effective to impart a predetermined beam spread to the light emitted from said dome end of said envelope; and a quantity of rare gas within said outer envelope having a fill pressure slightly less than one atmosphere and having a pressure at lamp operating temperature of approximately one atmosphere so that upon breakage of said blown glass envelope no substantial implosion or explosion occurs.

2. A high pressure sodium discharge reflector lamp, comprising:

a blown glass lamp envelope having a base end, and a reflective layer disposed covering a portion of said lamp envelope for reflecting and directing light emitted within said lamp envelope;

a lamp base mounted on said base end of said blown glass lamp envelope;

an elongate high pressure sodium discharge device mounted within said lamp envelope for emitting light incident on said reflective layer for reflection and direction by said reflective layer, with one end of said discharge device closer to said lamp base than the other end of said discharge device; and thermal control means for controlling the relative thermal dissipation of said ends of said discharge device for rendering the operating voltage thereof insensitive to the orientation of the lamp during lamp operation.

3. A high pressure sodium discharge reflector lamp according to claim 2, wherein said thermal control means is comprised of means for elevating the temperature of the end of said discharge device closest to said lamp base.

4. A high pressure sodium discharge reflector lamp according to claim 3, wherein said means for elevating the temperature is a heat shield on said end of said discharge device closest to said lamp base.

5. A high pressure sodium discharge reflector lamp according to claim 2, wherein said discharge device is comprised of a closed, hollow tubular body having a hollow cylindrical side wall and end walls closing said tubular body, a pair of discharge electrodes disposed within said tubular body at opposite ends thereof for defining a discharge gap between them, and electrode mounting means for mounting said discharge electrodes within said tubular body at opposite ends thereof and positioned with a tip end of each electrode facing the other electrode and with the tip end of each electrode spaced a certain distance from the adjacent end wall of said tubular body; and wherein said thermal control means is comprised of said electrode mounting means mounting the discharge electrode at the lamp base end of said tubular body closer to the adjacent end wall than the discharge electrode at the lamp dome end is to its adjacent end wall.

6. A high pressure sodium discharge reflector lamp according to claim 2, wherein said discharge device is comprised of a closed, hollow tubular body having a hollow cylindrical side wall and end walls closing said tubular body, a pair of discharge electrodes disposed within said tubular body at opposite ends thereof for defining a discharge gap between them, and electrode mounting means for mounting said discharge electrodes within said tubular body at opposite ends thereof and positioned with a tip end of each electrode facing the other electrode and with the tip end of each electrode spaced a certain distance from the adjacent end wall of said tubular body; and wherein said thermal control means is comprised of said electrode mounting means mounting the discharge electrode at the lamp base end of said tubular body closer to the adjacent end wall than the discharge electrode at the lamp dome end is to its adjacent end wall; and wherein said thermal control means is comprised of a thicker end wall at the lamp dome end of said discharge device than at the lamp base end of said discharge device.

7. In an electric reflector lamp of the type having a sealed blown glass outer envelope, a light source within said sealed outer envelope, and a reflective layer on a portion of said outer envelope for reflecting light from said light source and directing the reflected light, the improvement comprising: said light source comprising a high pressure sodium discharge device; and a quantity of rare gas within said sealed outer envelope and having a fill pressure at room temperature of slightly less than atmospheric pressure and a pressure at lamp operating temperature of about one atmosphere so that no substantial pressure difference exists between the lamp envelope interior and exterior and the lamp is substantially protected from implosion and explosion.

8. In an electric lamp according to claim 7, said high pressure sodium discharge device comprising a closed, hollow tubular body, a quantity of sodium within said tubular body, means for vaporizing the sodium and for ionizing the sodium vapor to emit light; and said improvement further comprising thermal control means for controlling the relative thermal dissipation of said ends of said discharge device for rendering the operating voltage thereof insensitive to the orientation of the lamp during operation.

9. In an electric lamp according to claim 8, wherein said thermal control means is a heat shield on one end of said discharge device for reducing the heat loss from said one end of said discharge device during lamp operation.

10. In an electric lamp according to claim 8, wherein said discharge device further comprises a pair of discharge electrodes disposed within said tubular body at opposite ends thereof for defining a discharge gap between them, and electrode mounting means for mounting said discharge within said tubular body at opposite ends thereof and positioned with a tip end of each electrode facing the outer electrode and with the tip end of each electrode spaced a certain distance from the adjacent end wall of said tubular body; and wherein said thermal control means is comprised of said electrode mounting means mounting one of said discharge electrodes closer to the adjacent end wall than the other discharge electrode is to its adjacent end wall.

* * * * *